US007174940B2

(12) United States Patent
Nien

(10) Patent No.: US 7,174,940 B2
(45) Date of Patent: Feb. 13, 2007

(54) ROLLER BLIND STRUCTURE

(76) Inventor: Leslie Nien, No.45-4, Fan Po St., Fu Hsing Hsiang, Changhua Hsien (TW)

( * ) Notice: Subject to any disclaimer, the term of this patent is extended or adjusted under 35 U.S.C. 154(b) by 161 days.

(21) Appl. No.: 10/968,062

(22) Filed: Oct. 20, 2004

(65) Prior Publication Data

US 2006/0021715 A1 Feb. 2, 2006

(30) Foreign Application Priority Data

Jul. 30, 2004 (TW) ..... 93212121 U

(51) Int. Cl.
*E06B 9/08* (2006.01)

(52) U.S. Cl. ..... 160/120; 160/85

(58) Field of Classification Search ..... 160/120, 160/121.1, 237, 241, 85, 86, 122
See application file for complete search history.

(56) References Cited

U.S. PATENT DOCUMENTS

| | | | | |
|---|---|---|---|---|
| 2,029,675 | A * | 2/1936 | Schlamp | 160/121.1 |
| 2,142,822 | A * | 1/1939 | Moore | 160/120 |
| 2,280,358 | A * | 4/1942 | Tietig | 160/120 |
| 2,281,022 | A * | 4/1942 | Cavanaugh | 160/85 |
| 3,789,904 | A * | 2/1974 | Takazawa | 160/120 |
| 3,980,122 | A * | 9/1976 | Takazawa | 160/85 |
| 4,418,739 | A * | 12/1983 | Woolnough et al. | 160/120 |
| 6,189,592 | B1 * | 2/2001 | Domel | 160/85 |

* cited by examiner

*Primary Examiner*—David Purol
(74) *Attorney, Agent, or Firm*—Troxell Law Office, PLLC

(57) ABSTRACT

A roller blind structure includes a roller shaft, a winding device with a linkage member attached at both ends of the roller shaft respectively to be actuated by an operating member for controlling the rolling or unrolling operation of a blind body. A pivoting rod is disposed at the outer side of the winding device and the linkage member thereof to be mounted to a support bracket fixed at both lateral sides of a window frame respectively. The support bracket thereof is provided with a series of retaining recesses concaved at preset positions thereon for holding in place a pair of clamping members astride side by side thereon, and the blind body has an extension piece of a proper length preset at the lower section thereof that, led backwards and upwards to pass between the two clamping members, is further extended to cover the upper side of the roller shaft with a sheltering cap formed thereon and securely located by the clamping members thereof. A counterweight article is placed at the curving turn of the blind body thereof to neatly separate the extension piece thereof from a decoration piece disposed at the front section of the blind body thereon wherein both the extension piece and the decoration piece thereof are respectively equipped with a plurality of light-passable areas alternatively arranged with a plurality of black-out areas so that the blind body can be flexibly adjusted to have it both ways with partial light and partial black-out effect, or to display in a complete black-out status to achieve best using condition and the interest of versatile changes thereof.

4 Claims, 4 Drawing Sheets

ROLLER BLIND STRUCTURE

BACKGROUND OF THE INVENTION

The present invention is related to a roller blind structure, including a blind body made up of an extension piece of a proper length preset at the lower section thereof that, led backwards and upwards to pass between a pair of clamping members bestriding side by side support brackets fixed at both left/right sides of a window frame, is further extended to cover the upper side of a roller shaft with a sheltering cap formed thereon and securely hold in place by the clamping members thereof. A counterweight article is located at the curving turn of the blind body thereof to neatly separate in space the extension piece thereof from a decoration piece disposed at the front section of the blind body thereon wherein both the extension piece and the decoration piece thereof are respectively equipped with a plurality of light-passable areas alternatively arranged with a plurality of black-out areas so that the blind body can be flexibly adjusted to have it both ways with partial light and partial black-out effect, or to display in a complete black-out status to achieve best using condition and the interest of versatile changes thereof.

As shown in FIG. 1, a conventional roller blind 10 is made up of a blind body 11 simply wound around a roller shaft 12 and suspended downwards there-from. In the rolling or unrolling operation thereof, the actuation operation of the blind body 11 via the rolling shaft 12 is directly exposed outside without any decoration covering. The blind body 11 is simply suspended downwards at the underside of the roller shaft 12 in a single piece. Thus, the blind body 11 is rather monotonously made in either a light-passable fabric or a black-out fabric without the versatility to have it both ways with partial light-passable fabric and partial black-out fabric thereof.

SUMMARY OF THE PRESENT INVENTION

It is, therefore, the primary purpose of the present invention to provide a roller blind structure, including a blind body made up of an extension piece of a proper length preset at the lower section thereof that is wound backwards and led upwards to pass between a pair of clamping members bestriding side by side support brackets fixed at both left/right sides of a window frame and be securely hold in place thereby. A counterweight article is located at the curving turn of the blind body thereof to neatly separate in space the extension piece thereof from a decoration piece disposed at the front section of the blind body thereon wherein both the extension piece and the decoration piece thereof are respectively equipped with a plurality of light-passable areas alternatively arranged with a plurality of black-out areas so that the blind body can be flexibly adjusted according to the winding position of a roller shaft to have it both ways with partial light and partial black-out effect, or to display in a complete black-out status to achieve best using condition and the interest of versatile changes thereof.

It is, therefore, the second purpose of the present invention to provide a roller blind structure wherein the extension piece of the blind body, led backwards and upwards to pass between the clamping members thereof, is further extended to cover the upper side of the roller shaft with a sheltering cap formed thereon so as to conceal the actuation operation of the roller shaft and the blind body thereof, facilitating the overall beauty of the roller blind in display.

DETAILED DESCRIPTION OF THE PREFERRED EMBODIMENTS

Figure 1:
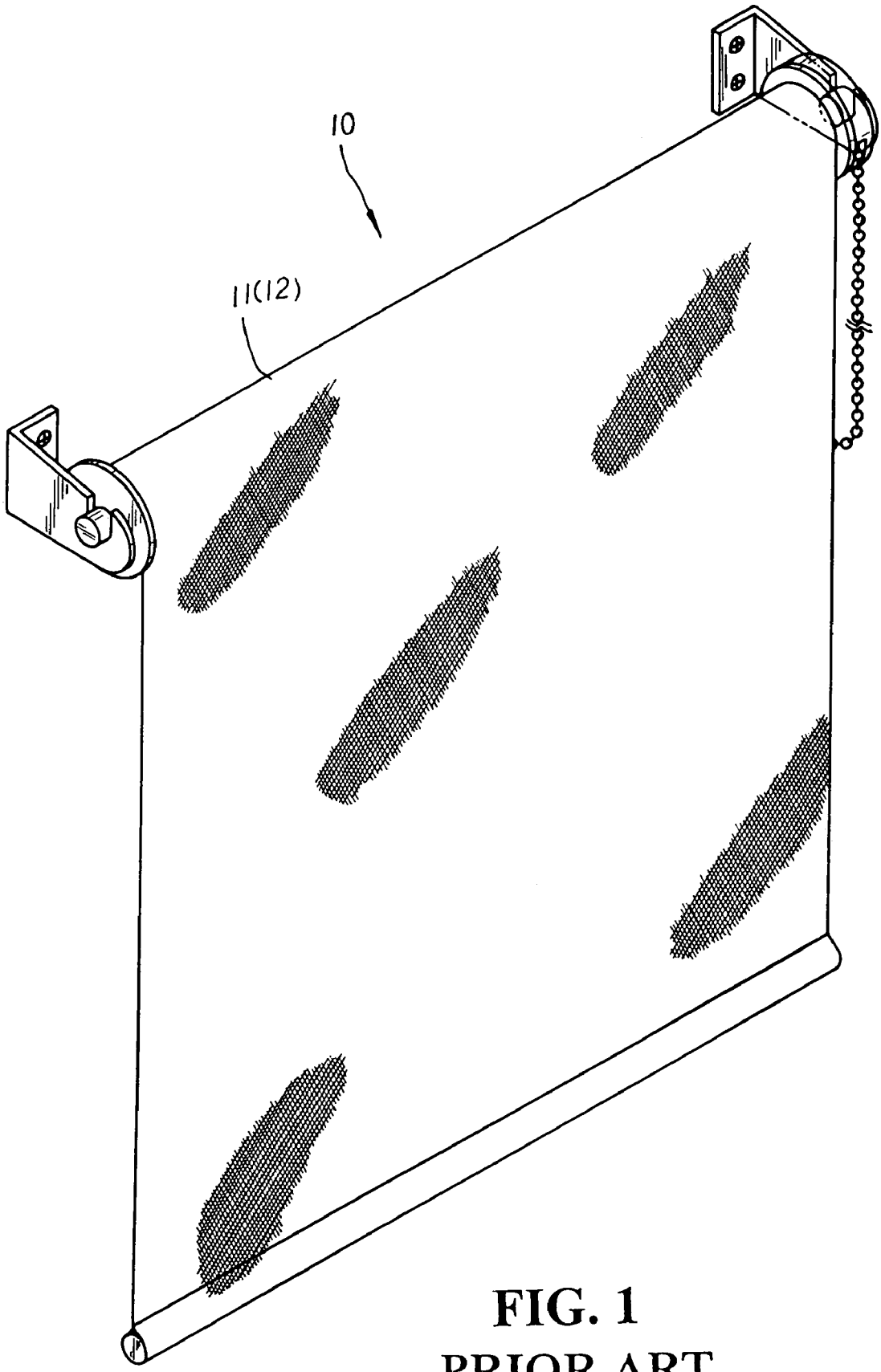
FIG. 1 PRIOR ART
FIG. 1 is a perspective view of a conventional roller blind structure.
Figure 2:
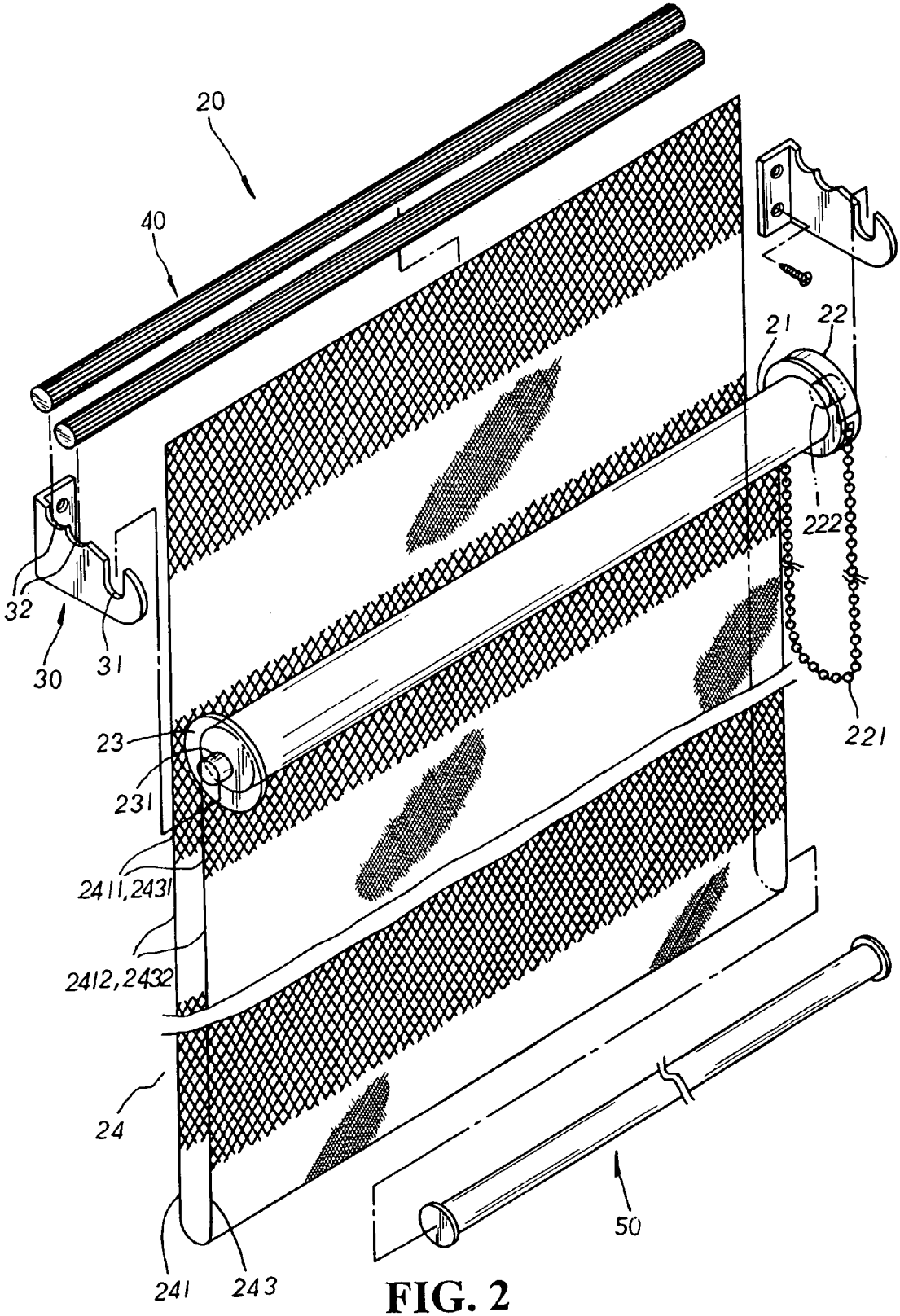
FIG. 2 is a perspective exploded view of the present invention.
Figure 3:
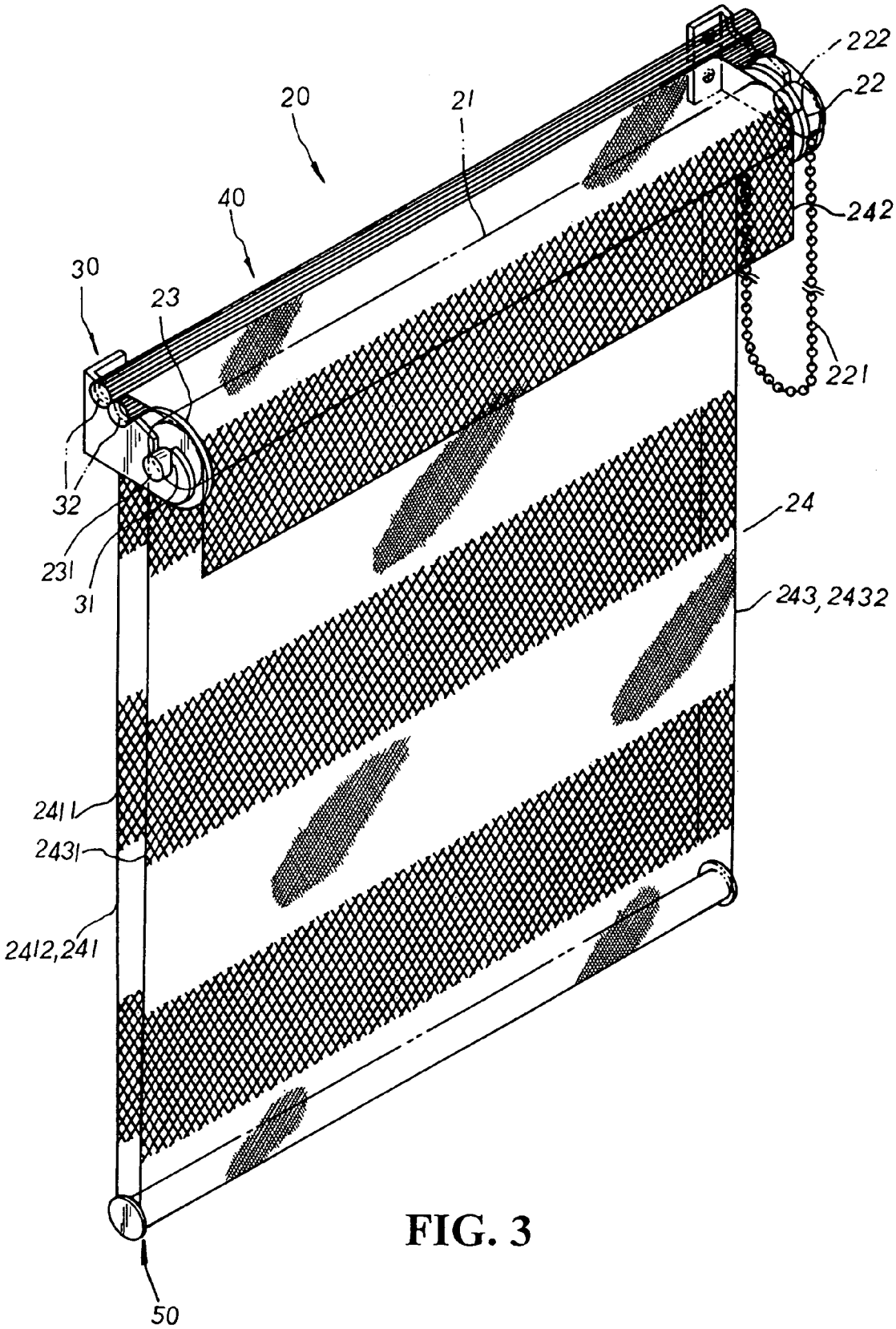
FIG. 3 is a diagram showing the operation of the present invention in assembly.

As shown in FIGS. 2 to 3 the present invention is related to a roller blind structure, including a roller blind 20 made up of a roller shaft 21, a winding device 22 with a linkage member 23 attached at both ends of the roller shaft 21 respectively to be actuated by an operating member 221 such as a beaded chain, and a pivoting rod 222, 231 protruding at the outer side of the winding device 22 and the linkage member 23 thereof to be mounted into a U-shaped pivoting groove 31 of a support bracket 30 fixed at both left/right sides of a window frame respectively. Thus, when pulled by the operating member 221 thereof, the winding device 22 and the linkage member 23 will actuate the roller shaft 21 to rotate either clockwise or counterclockwise accordingly so as to control the rolling or unrolling operation of a blind body 24 thereby. A series of curved retaining recesses 32 are sequentially concaved at preset positions of the support brackets 30 for holding in place a pair of rod-like clamping members 40 astride side by side thereon. The blind body 24 is provided with an extension piece 241 of a proper length preset at the lower section thereof that, wound backwards and led upwards to pass between the two clamping members 40, is further extended to cover the upper side of the roller shaft 21 with a sheltering cap 242 formed thereon and securely located via the clamping members 40 thereof. A rod-like counterweight article 50 is placed at the curving turn of the blind body 24 thereof to neatly separate in space the extension piece 241 thereof from a decoration piece 243 disposed at the front section of the blind body 24 thereof. The extension piece 241 and the decoration piece 243 of the blind body 24 are respectively equipped with a plurality of light-passable areas 2411, 2431 alternatively arranged with a plurality of black-out areas 2412, 2432 correspondingly disposed at the surface thereon.

In practical use, when the light-passable areas 2431, 2411 of the decoration piece 243 and the extension piece 241 of the blind body 24 thereof are correspondingly juxtaposed one to another in arrangement as shown in FIG. 3, sunlight or moonbeam is partially allowed to filter through the blind body 24 and come indoors via the light-passable areas 2431, 2411 with a transparent effect thereof. And via the light-passable areas 2431, 2411 thereof, one can easily see the view outside without the blind body 24 being rolled upwards for the purpose thereof. Due to the black-out areas 2432, 2412 alternatively arranged with the light-passable areas 2431, 2411 thereof, light filtering through the blind body 24 thereof is partially sheltered by the black-out areas 2432, 2412 in interval, softening the dazzling sunlight during the daytime to provide a gentle transparent effect as well as blocking out the moonbeam in contrast with the light filtering through the light-passable areas 2431, 2411 to provide a unique shading effect thereof.

Figure 4:
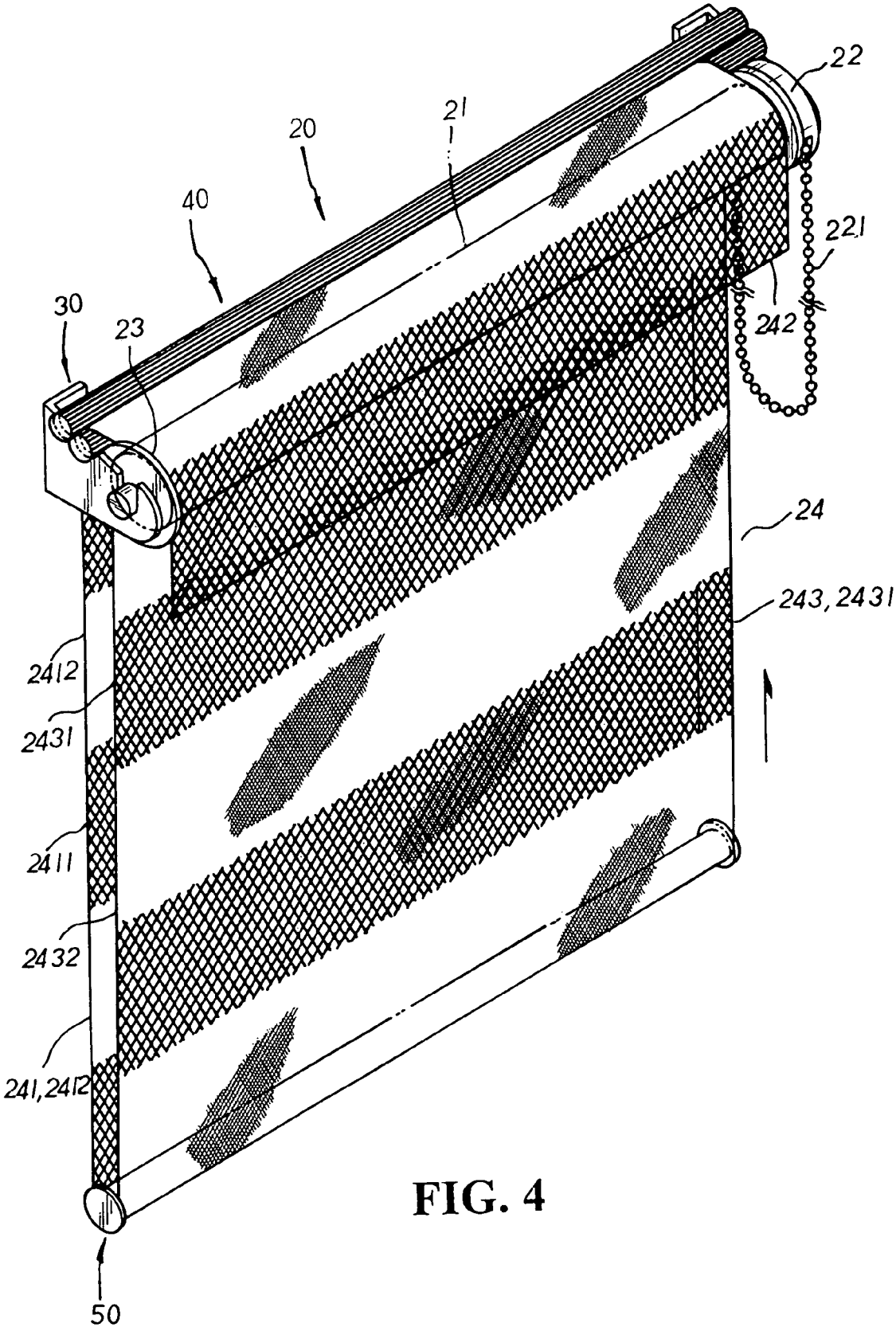
FIG. 4 is another diagram showing the present invention in practical use.

As shown in FIG. 4, when the blind body 24 is wound via the operating member 221 till the black-out areas 2432 of the decoration piece 243 are correspondingly juxtaposed with the light-passable areas 2411 of the extension piece 241 thereof in arrangement, the light-passable areas 2431 of the decoration piece 243 are precisely sheltered by the black-out areas 2412 of the extension piece 241 respectively, completely blocking all view and light outdoors to achieve universal sheltering and light control effect thereof.

What is claimed is:

1. A roller blind structure comprising:

a) a roller blind having:

i) a roller shaft;

ii) an operating member;

iii) a winding device having a linkage member attached at each of two ends of the roller shaft; and iv) two pivoting rods, one of the two pivoting rods is located at each of the two ends of the roller shaft and protruding outwardly from an outer side of the winding device;

b) a pair of clamping members;

c) two support brackets, each of the two support brackets having:

i) a pivoting groove, one of the two pivoting rods is inserted into the pivoting groove of each of the two support brackets; and ii) a plurality of retaining recesses, a first end of each of the pair of clamping members is located in one of the plurality of retaining recesses of a first of the two support brackets and a second end of each of the pair of clamping members is located in one of the plurality of retaining recesses of a second of the two support brackets;

d) a blind body having:

i) an extension piece inserted through and selectively fixed in a predetermined position by the pair of clamping members, the extension piece having a sheltering cap located on a first end thereof and covering an upper side of the roller shaft; and ii) a decoration piece having a first end connected to a second end of the extension piece and a second end connected to the roller shaft, the operating member controlling the winding device and the linkage member, the winding device and the linkage member selectively rotating the roller shaft clockwise and counterclockwise and selectively rolling and unrolling the blind body, each of the extension piece and the decoration piece having a plurality of light-passable areas alternatively arranged with a plurality of black-out areas on a surface thereof; and e) a counterweight article placed in a curving turn of the blind body separating the extension piece and the decoration piece.

2. The roller blind structure according to claim 1 wherein the plurality of retaining recesses of the each of the two support brackets are a plurality of consecutive curved shapes.

3. The roller blind structure according to claim 1 wherein each of the pair of clamping members has a rod shape.

4. The roller blind structure according to claim 1 wherein the counterweight article has a rod shape.

* * * * *